US009151151B2

(12) United States Patent
Völkel

(10) Patent No.: US 9,151,151 B2
(45) Date of Patent: Oct. 6, 2015

(54) METHOD FOR LOCALIZING A DRILLING DEVICE OF AN EARTH DRILLING APPARATUS

(75) Inventor: Gerhard Völkel, Erndtebrück (DE)

(73) Assignee: RAYONEX BIOMEDICAL GMBH, Lennestadt (DE)

( * ) Notice: Subject to any disclaimer, the term of this patent is extended or adjusted under 35 U.S.C. 154(b) by 1033 days.

(21) Appl. No.: 13/259,609

(22) PCT Filed: Mar. 24, 2010

(86) PCT No.: PCT/EP2010/001845

§ 371 (c)(1), (2), (4) Date: Dec. 6, 2011

(87) PCT Pub. No.: WO2010/108666

PCT Pub. Date: Sep. 30, 2010

(65) Prior Publication Data

US 2012/0098675 A1 Apr. 26, 2012

(30) Foreign Application Priority Data

Mar. 25, 2009 (DE) ..... 10 2009 014 887

(51) Int. Cl.

| | |
|---|---|
| ***E21B 47/022*** | (2012.01) |
| ***E21B 47/024*** | (2006.01) |
| ***E21B 7/04*** | (2006.01) |

(52) U.S. Cl.

CPC ..... *E21B 47/024* (2013.01); *E21B 7/046* (2013.01); *E21B 47/02224* (2013.01)

(58) Field of Classification Search

CPC ..... E21B 44/00; E21B 47/02216; E21B 47/02224; E21B 47/024

USPC ..... 340/853.5; 324/326, 329, 334, 338, 324/346; 175/61–62, 24

See application file for complete search history.

(56) References Cited

U.S. PATENT DOCUMENTS

| | | | | |
|---|---|---|---|---|
| 3,406,766 | A | 10/1968 | Henderson | |
| 4,460,059 | A | 7/1984 | Katz | |
| 5,258,755 | A | 11/1993 | Kuckes | |
| 5,264,795 | A | 11/1993 | Rider | |
| 5,585,726 | A * | 12/1996 | Chau | 324/326 |
| 7,775,301 | B2 * | 8/2010 | Brune et al. | 175/61 |
| 8,381,836 | B2 * | 2/2013 | Brune et al. | 175/24 |

FOREIGN PATENT DOCUMENTS

DE 10 2004 058 272 A1 6/2005

* cited by examiner

*Primary Examiner* — Albert Wong
(74) *Attorney, Agent, or Firm* — Howard IP Law Group, PC

(57) ABSTRACT

The invention relates to a method for localizing a drilling device of an earth drilling apparatus, wherein a localization signal is emitted by the drilling device, said signal being received by an external receiver and evaluated for determining the position of the drilling device, wherein an output signal, which is converted into the localization signal, is fed to the drilling device via a connection line, which is connected to the drilling device.

14 Claims, 3 Drawing Sheets

METHOD FOR LOCALIZING A DRILLING DEVICE OF AN EARTH DRILLING APPARATUS

CROSS-REFERENCES TO RELATED APPLICATIONS

This application is the U.S. National Stage of International Application No. PCT/EP2010/001845, filed Mar. 24, 2010, which designated the United States and has been published as International Publication No. WO 2010/108666 A2 and which claims the priority of German Patent Application, Serial No. 10 2009 014 887.6, filed Mar. 25, 2009, pursuant to 35 U.S.C. 119(a)-(d).

BACKGROUND OF THE INVENTION

The invention relates to a method for localizing a drilling device of an earth drilling apparatus.

When introducing boreholes in the soil, it is typically necessary to control the exact drilling path. This requires localizing the drilling device within the soil to check if the drilling device follows the prescribed drilling path by comparing the actual position of the drilling device with its nominal position.

Control of the drilling path is particularly important when producing a horizontal borehole. In particular, horizontal boreholes are introduced in the soil in the context of trench-less installation and trench-less exchange of supply lines, for example freshwater and sewage lines, telecommunication cables, etc., and frequently extend from a starting pit to a destination pit. However, it is also known to introduce horizontal boreholes into the soil by initially drilling into the soil from the ground surface at an angle, whereafter the borehole is deflected into the horizontal direction, with the borehole continuing over the predetermined distance, until the drilling device again reaches a destination pit; alternatively, the drilling device can also be redirected after the horizontal section of the drilling path, this time towards the ground surface, so that the drilling device again exits the soil at the ground surface. It is evident that controllable drilling devices are required for producing a drilling path that is not straight. However, the use of controllable drilling devices may also make sense when a straight borehole should be drilled from the starting pit towards the destination pit; the drilling device frequently hits an obstacle during advance of the drilling device, for example a rock which cannot be penetrated, or an already existing supply line (e.g., water, gas or electricity line) which must not be damaged. In this situation, the obstacle must be "driven around" by diverting the earth drilling apparatus. However, this maneuver requires a precise localizing of the drilling device and in particular of the drilling head of this drilling device.

Several systems are known in the art which can be used to localize a drilling device of an earth drilling apparatus in the soil. The conventional systems have each a transmitter arranged inside the drilling head or in another section of the drilling device of the earth drilling apparatus, wherein the transmitter should be localized as closely as possible near the drilling head. The transmitter transmits a localization signal which is received by a receiver arranged above ground. The receiver evaluates the received localization signal to determine the position of the sensor and hence of the drilling head in the soil.

In one conventional system for localizing a drilling device, the drilling device has a magnetic dipole in the region of the drilling head which is rotatively driven together with the drilling device of the earth drilling apparatus. The magnetic field emitted by the magnetic dipole is measured by a receiver unit arranged above ground as a changing magnetic field, from which the position of the magnetic dipole and its orientation can be determined; the position and orientation of the drilling head can be directly determined due to the fixed arrangement between the magnetic dipole and the drilling head.

Other conventional systems based on the same principle for localizing a drilling device use a separate drive for the magnetic dipole, so that a localizing function can also be attained when the drilling device does not rotate.

Still other conventional systems use for producing the time-dependent magnetic field instead of a rotating magnetic dipole one or several coils to which an AC voltage is applied.

In the conventional systems, the transmitters arranged in the drilling devices are designed as active transmitters, i.e., they generate the corresponding localization signal either permanently without supply of an external signal or from energy (e.g., the aforedescribed system based on a permanent magnet), or the transmitters are supplied with electric energy and produce the localization signal by way of a corresponding conversion of the electric energy. The transmitters are typically supplied with energy from batteries. To eliminate the maintenance costs associated with changing the batteries, it has also been proposed to drive a mini-generator arranged in the drilling head with the flushing fluid which is provided anyway and introduced into the soil to improve the advance of the drilling device and to flush the drilling debris out of the borehole.

The conventional systems are technically complex and can retrofitted into existing drilling devices of earth drilling apparatuses either not at all or only at significant costs. Systems including electrical components (e.g., the rotary drive for the magnetic dipole, a coil, etc.) are frequently also susceptive to malfunction, because the electrical components can be damaged by the vibrations and impacts that are present during the drilling operation.

Based on this state-of-the-art, it was the object of the invention to provide an improved method for localizing a drilling device of an earth drilling apparatus which ameliorates these disadvantages. In addition, a corresponding system for localizing a drilling device of an earth drilling apparatus is provided.

SUMMARY OF THE INVENTION

This object is solved by a method for localizing a drilling device of an earth drilling apparatus, with the steps of supplying an output signal to the drilling device via a connecting line connected with the drilling device, generating a localization signal by conducting the output signal via a housing of the drilling device, transmitting the localization signal with the drilling device, receiving the transmitted localization signal with an external receiver, and evaluating the received localization signal in the external receiver to determine a position of the drilling device.

The invention is based on the concept that the localization signal is no longer generated by a transmitter arranged in the region of the drilling device and in particular of a drilling head of this drilling device, but that instead a corresponding signal generating device is provided outside the drilling device, wherein the corresponding localization signal is conducted from the external signal generating device via a connecting line to the drilling device localized in the soil, from which the localization signal is then transmitted into the surrounding soil, so that it can be received by a corresponding external receiver and evaluated for determining the position of the drilling device. The potentially technically complex signal generating device, which may also require significant amount of space inside the drilling device, then no longer needs to be integrated in the drilling device, so that the signal generating device can be arranged outside the drilling device and preferably above ground. Optionally, the signal generating device can be integrated in a housing with one or more of the components of the earth drilling apparatus, e.g., an oiler, obviating the need to position additional components at the construction site. With the invention, not only is the integration of the signal generating device in the drilling device itself eliminated, but the signal generating device is now also in a region where it is protected from the sometime significant stress to which the drilling device is subjected during the drilling operation. With the present invention, existing earth drilling apparatuses can also be easily retrofitted with a corresponding localizing system.

In a method according to the invention for localizing a drilling device of an earth drilling apparatus, an output signal generated by a signal generating device is supplied to the drilling device via a connecting line connected with the drilling device, wherein the output signal is converted by the drilling device, and in particular in the region of a drilling head of the drilling device, into a localization signal, which is in turn transmitted by the drilling device, so that it can be received by an external receiver and evaluated for determining the position of the drilling device and in particular of the drilling head.

According to the invention, "converting" the output signal into a localization signal does not require that the output signal and the localization signal must be of different types. It is only relevant that the output signal and the localization signal can be differentiated by the receiver, allowing the drilling device to actually be localized. Such differentiation, however, is only possible if the output signal and the localization signal are different in some way. Within the context of the invention, the output signal is considered to be "converted" into a localization signal if, for example, the receiver is prevented from detecting the output signal even if the output signal and the localization signal are identical, with the receiver then receiving only the localization signal. This may be accomplished, for example, by suitably shielding the connecting line. Alternatively, the output signal and the localization signal may be differentiated that if the localization signal is not only transmitted by the drilling device or the drilling head itself, but also by the connecting line, wherein the drilling device or the drilling head can be identified because transmission of the localization signal ends at its front end, which can be measured by the receiver.

A corresponding system for localizing a drilling device of an earth drilling apparatus has, in addition to the drilling device, at least one receiver for receiving and evaluating a localization signal transmitted by the drilling device and a signal generating device which is connected with the drilling device via a connecting line.

The receiver may, of course, also be constructed in several parts, i.e., for example with a receiving unit and a evaluating unit, which may also be localized at a distance from one another (e.g., the receiving unit in one embodiment as a so-called "walk-over" receiver, i.e., a portable receiver, which is positioned above the drilling device, and an evaluating unit which may be arranged in the area of an operator console of the earth drilling apparatus).

According to the invention, "drilling device" refers to the component of an earth drilling apparatus with which the soil is removed or displaced. However, the term "drilling device" should not be constructed so narrowly that only a tool arranged at the front end is included; instead, a "drilling device" may also include additional components of the earth drilling apparatus connected with the tool, for example a housing with a pneumatic drive arranged therein or a hydraulic rotary drive ("mud motor"). The term "drilling device" may hence also include a complete drilling unit, for example an earth rocket (i.e., a self-propelled pneumatic impact drilling device).

Preferably, a supply line connected with the drilling device may be used for transmitting the output signal. Each drilling device of an earth drilling apparatus typically includes a corresponding supply line.

"Supply line" refers to any line (e.g., rod assembly, tube, hose, etc.) used to transmit signals or energy to the drilling device or to transmit forces and moments. These include, in particular, drilling rods and hoses for supplying a fluid (in particular for the operation of earth rockets) and cables for, for example, an electric energy supply.

In a particular preferred embodiment of the method of the invention, a current flow through the drilling device caused by an electric voltage (in particular an AC voltage) is produced as an output signal, whereby the typically metallic drilling device produces a magnetic field as the localization signal. The connecting line and the drilling device of the apparatus are at least partially electrically conducting so that a corresponding magnetic field is generated in response to the current flow caused by the (AC) voltage (similar to a magnetic field produced by the current flowing through a conductor). In this way, the system according to the invention can be implemented with a simple structure; only required is a suitable signal generating device generating an (AC) voltage, which itself can have a simple design and is commercially available, because it can be used for other applications, and a receiver configured to measure and evaluate the generated magnetic field. Because a drilling device of an earth drilling apparatus is generally made of metal, and in particular of steel, the only requirement is an electrical connection between the drilling device and the signal generating device via a corresponding connecting line. If the drilling device is connected with a rod assembly, which is typically also made of a metal and particularly of steel, then the rod assembly operating as the connecting line generally already provides the electrical conductivity.

The signal generating device can be coupled to the connecting line, for example, directly (galvanically) or also inductively.

The method of the invention can be easily implemented also with earth rockets, which are typically provided with operating air pressure through a flexible air hose made of plastic. The compressed air hose itself may be constructed to be electrically conducting, for example by providing the hose with a metal, in particular steel reinforcement. An electrically conducting connection between the compressed air hose and the housing of the earth rocket should be provided. In an alternative embodiment, an electrically conducting cable, in particular a steel cable, via which the output signal is transmitted, may be carried along in parallel with the compressed air line. The cable can be carried along outside as well as inside the supply line (in particular the compressed air line) of the earth rocket.

In a preferred embodiment of the method according to the invention and the system, a magnetic field is generated by the reversal of the electromagnetic induction, which is oriented circular or perpendicular to the longitudinal axis of the drilling device (corresponding to the drilling axis); the magnetic field ends shortly before the tip of the drilling device ("signal decay") which can be measured by the receiver. This enables a particularly accurate localizing of the tip of the drilling device, which is particularly advantageous because the drilling path (which is to be frequently controlled) can be very precisely controlled by monitoring the movement of the tip of the drilling device.

An electrically conducting connecting line can additionally be used to transmit additional signals. For example, one or more sensors may be arranged in the region of the drilling device and in particular of the drilling head of the drilling device, with the measurement values from the sensor(s) being transmitted via the electrically conducting connecting line to an external display device which is preferably arranged above ground, where the measurement value can be graphically displayed.

For example, the drilling device and/or the drilling head can then be provided with a sensor for detecting a current-carrying line located in front of the drilling head, wherein the electrically conducting connecting line can be used to transmit the measurement values from the sensor to a signaling device (e.g., warning lamp, warning horn) which signals, for example, to an operator of the earth drilling apparatus when the drilling device or the drilling head hits the current-carrying line. The measurement values of the sensor can also be used for automatically shutting down the earth drilling apparatus when the drilling device or the drilling head hits the current-carrying line.

It will be understood, that the invention is not limited to converting a current flow produced by an (AC) voltage into a magnetic field, but includes all methods and systems recited in the independent claims where an output signal supplied to the drilling device via a connecting line is converted by the drilling device into a corresponding localization signal, which can then be received by a corresponding receiver and evaluated to determine the position of the drilling device. For example, acoustic waves may be transmitted (e.g., via the compressed air pressure of the earth rocket or the flushing fluid of the earth drilling apparatus) and converted by the drilling device into corresponding body vibrations, which can in turn be transmitted to the soil and received and evaluated by a suitable receiver.

BRIEF DESCRIPTION OF THE DRAWING

The invention will now be described in more detail with reference to exemplary embodiments illustrated in the drawings.

The drawings show in.

DETAILED DESCRIPTION OF PREFERRED EMBODIMENTS

Figure 1:
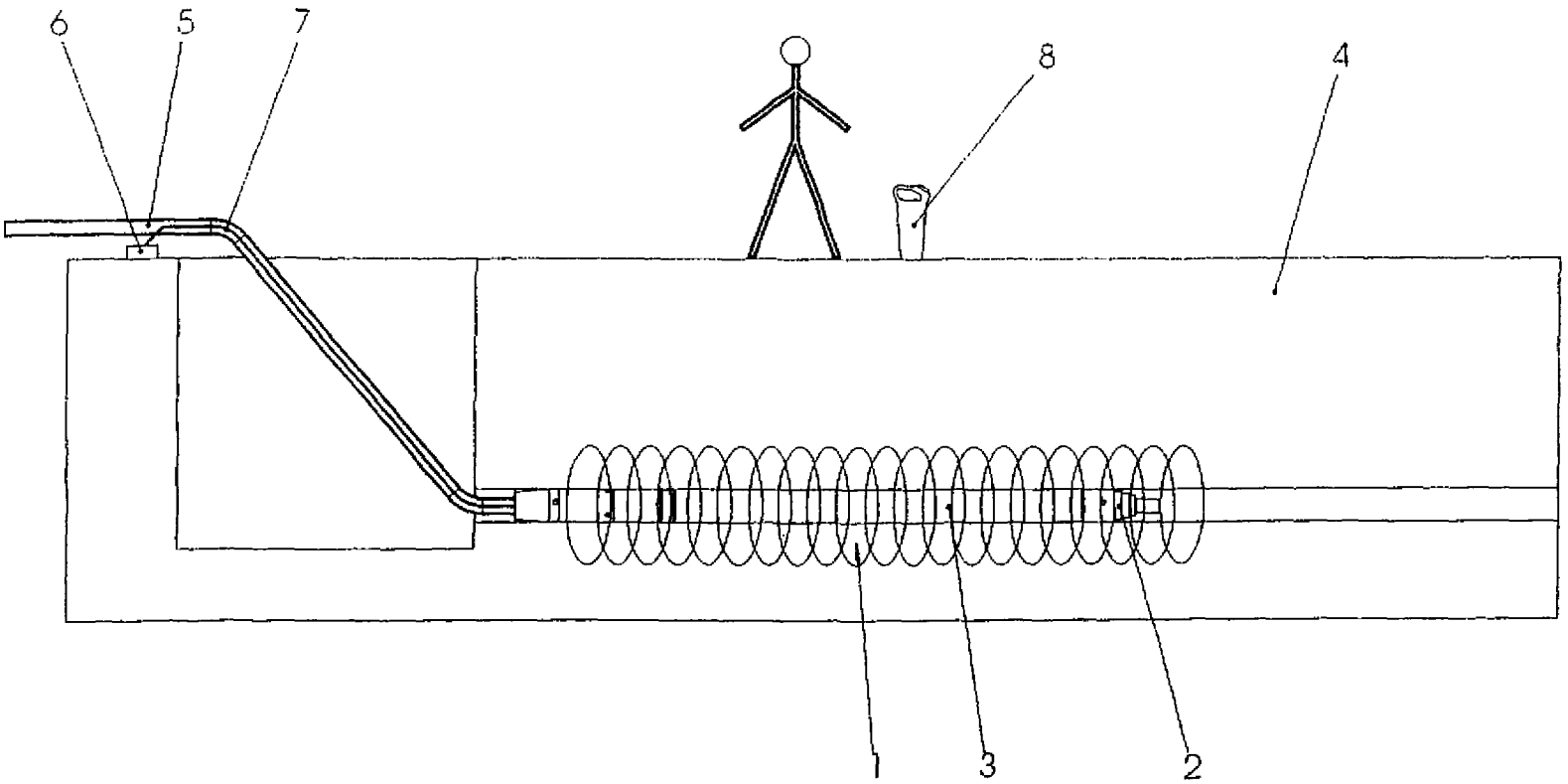
FIG. 1 in a schematic diagram, a system according to the invention in a first embodiment.

FIG. 1 shows a system according to the invention for localizing a drilling device of an earth drilling apparatus. The exemplary drilling device is a so-called earth rocket 1, i.e., a self-propelled impact drilling device with an internal impact piston which during each cycle of the back and forth motion produced by the compressed air strikes an impact surface of a drilling head 2 or a housing 3 of the earth rocket 1 and thereby transfers its kinetic energy to the drilling head 2, so that the earth rocket 1 is advanced step-by-step through the soil 4. The compressed air required for operating the earth rocket 1 is supplied to the earth rocket 1 via a compressed air hose 5 from the compressed air supply unit (not illustrated) localized above ground. The further design and function of an earth rocket 1 are known in the art.

The illustrated system according to the invention further includes a signal generating device implemented as an AC voltage generator 6; the design and function of an AC voltage generator are known in the art. The AC voltage generator 6 is connected with the housing 3 of the earth rocket 1 via a connecting line, in the present example a cable 7, which is routed through the compressed air hose 5.

Figure 3:
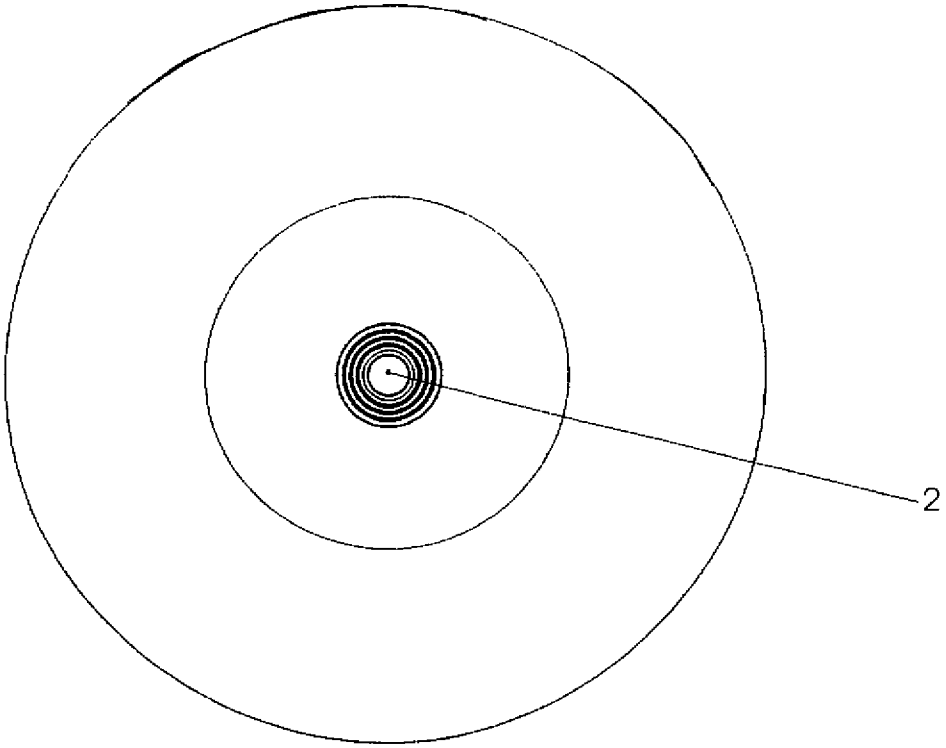
FIG. 3 in a schematic diagram, the propagation of a magnetic field in a radial direction in a system according to FIG. 1 or FIG. 2.

The AC voltage produced by the AC voltage generator 6 causes a continually changing current flow through the cable 7 and the housing 3 made of steel as well as through the drilling head 2 of the earth rocket 1 which is also made of steel, which in turn induces a magnetic field that propagates circularly about the longitudinal axis of the earth rocket 1 (see FIG. 3). The magnetic field can be measured with a receiver, for example a (three-axes) magnetometer and evaluated to determine the position of the earth rocket in the soil. A so-called "walk-over" receiver 8, i.e., a portable receiver, is used in the exemplary embodiments illustrated in the figures. The design and the function of this type of "walk-over" receiver are known in the art.

The magnetic field generated by the current flowing through the housing and the drilling head, respectively, terminates shortly before the tip of the drilling head 1; this can be measured by the "walk-over" receiver as a signal decay. The position of the drilling head tip of the earth rocket 1 can then be localized relatively precisely, which is particularly advantageous for determining the drilling path.

Figure 2:
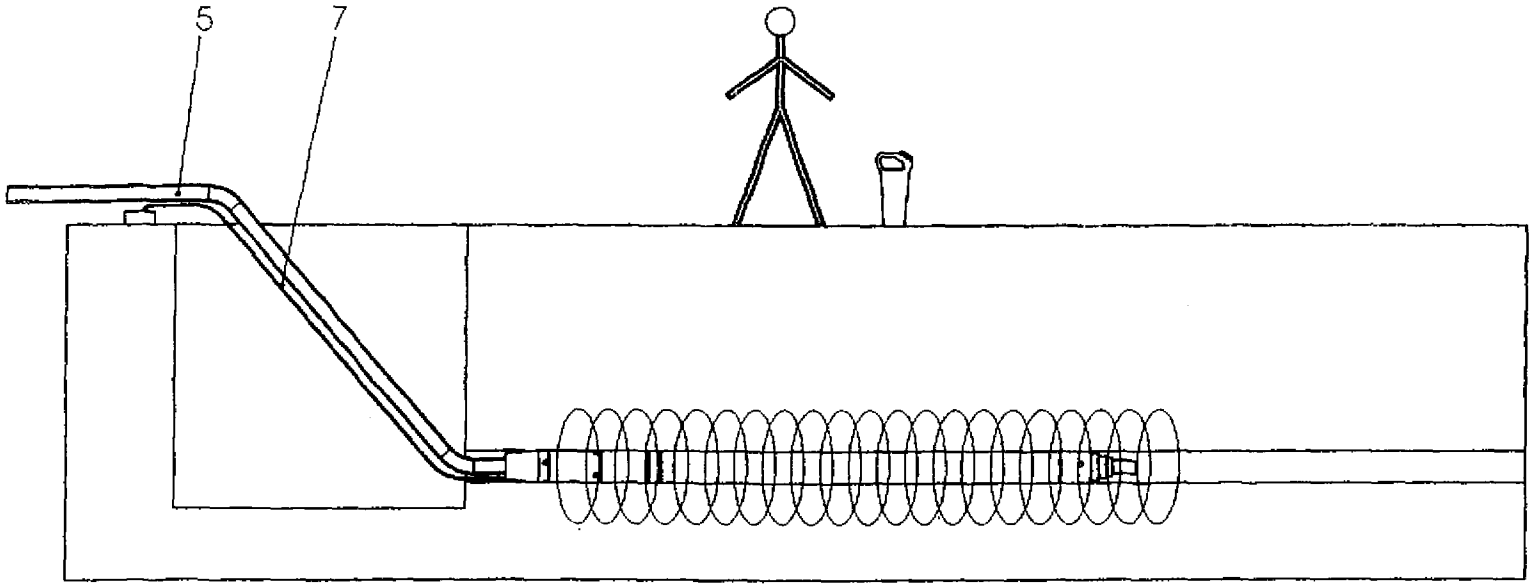
FIG. 2 in a schematic diagram, a system according to the invention in a second embodiment.

FIG. 2 shows a system according to the invention for localizing a drilling device of an earth drilling apparatus, wherein only the routing of the current-conducting cable 7' has been changed compared to the embodiment of FIG. 1. In the exemplary embodiment according to FIG. 2, the cable 7' is routed outside and next to the compressed air hose 5'.

The invention claimed is:

1. A method for localizing a drilling device of an earth drilling apparatus, comprising the steps of:

supplying an output signal to the drilling device via a connecting line electrically connected with a housing of the drilling device, generating a localization signal by conducting the output signal via the housing of the drilling device, transmitting the localization signal with the drilling device, receiving the transmitted localization signal with an external receiver, and evaluating the received localization signal in the external receiver to determine a position of the drilling device.

2. The method of claim 1, wherein the output signal is transmitted via a supply line of the drilling device.

3. The method of claim 1, wherein the output signal is generated by a current flow through the drilling device caused by an AC voltage, wherein the current flow produces a magnetic field as the localization signal.

4. A system for localizing a drilling device of an earth drilling apparatus, the system comprising:

the drilling device having a housing, an external signal generating device in electrical communication with the housing of the drilling device via a connecting line for generating a localization signal by conducting an output signal of the signal generating device via the housing of the drilling device, and a receiver for receiving and evaluating the localization signal transmitted by the drilling device.

5. The system of claim 4, wherein the connecting line is a supply line of the drilling device.

6. The system of claim 4, wherein the connecting line and the drilling device are constructed to be at least partially electrically conducting and wherein the output signal comprises an AC voltage which causes a magnetic field surrounding at least the drilling device.

7. The system of claim 4, wherein the drilling device is an earth rocket.

8. The system of claim 5, wherein the supply line is constructed as a metal-reinforced supply hose.

9. The system of claim 5, wherein the supply line comprises a metal cable.

10. The system of claim 4, further comprising:

a sensor arranged in a region of the drilling device, and a console for displaying measurement values of the sensor, wherein the measurement values are transmitted via the connecting line.

11. The system of claim 10, wherein the sensor is configured to detect a current-carrying line located in front of the drilling device.

12. An earth drilling apparatus comprising:

a drilling device having a housing, an external signal generating device electrically connected with the housing of the drilling device for generating a localization signal by conducting an output signal of the signal generating device via the housing of the drilling device, and a receiver for receiving and evaluating the localization signal transmitted by the drilling device.

13. The system of claim 4, wherein the connecting line is shielded along its length between the external signal generating device and the drilling device.

14. The method of claim 1, further comprising the step of converting the output signal into the localization signal, wherein the output signal and the localization signal can be distinguished by the external receiver.

* * * * *